US007310960B2

(12) United States Patent
Sienel et al.

(10) Patent No.: US 7,310,960 B2
(45) Date of Patent: Dec. 25, 2007

(54) TRANSCRITICAL HEAT PUMP WATER HEATER WITH DRAINAGE

(75) Inventors: Tobias Sienel, East Hampton, MA (US); Lili Zhang, East Hartford, CT (US); Nicolas Pondicq-Cassou, Lyons (FR)

(73) Assignee: Carrier Corporation, Syracuse, NY (US)

( * ) Notice: Subject to any disclaimer, the term of this patent is extended or adjusted under 35 U.S.C. 154(b) by 88 days.

(21) Appl. No.: 11/068,413

(22) Filed: Feb. 28, 2005

(65) Prior Publication Data

US 2006/0191276 A1 Aug. 31, 2006

(51) Int. Cl.
*F25B 27/00* (2006.01)

(52) U.S. Cl. ..... 62/238.6; 165/140

(58) Field of Classification Search ..... 62/238.6, 62/238.7, 180, 179; 165/140; 237/2 B
See application file for complete search history.

(56) References Cited

U.S. PATENT DOCUMENTS 4,517,827 A * 5/1985 Tapscott ..... 73/45.4
4,528,822 A * 7/1985 Glamm ..... 62/238.7
4,616,487 A * 10/1986 Franklin ..... 62/235.1
5,367,885 A * 11/1994 Sagar ..... 62/125
5,772,113 A * 6/1998 Gerstmann et al. ..... 237/8 R
5,984,198 A 11/1999 Bennett

* cited by examiner

*Primary Examiner*—Melvin Jones
(74) *Attorney, Agent, or Firm*—Carlson, Gaskey & Olds

(57) ABSTRACT

A water heater is provided by a refrigerant cycle, in which the gas cooler is utilized to heat the water. A drain is incorporated into a water circuit for draining all of the water outwardly of the circuit when the system is shut down. In a preferred embodiment, a water outlet of the gas cooler is at the vertically lowermost portion of the water circuit. A drain valve is placed in this vertically lowermost location such that the water can be easily drained.

13 Claims, 1 Drawing Sheet

TRANSCRITICAL HEAT PUMP WATER HEATER WITH DRAINAGE

BACKGROUND OF THE INVENTION

This application relates to a heat pump being utilized to heat water, and wherein the water cycle is provided with a drain line at a position to protect a gas cooler and other components.

Refrigerant cycles are utilized in many applications to heat or cool another fluid. As an example, refrigerant cycles are often utilized to condition air being delivered into an environment. A typical refrigerant cycle includes a compressor compressing a refrigerant, and delivering that refrigerant to a first heat exchanger known as a condenser. In this heat exchanger, the hot refrigerant loses heat to another fluid, and the refrigerant then passes downstream to an expansion device. In the expansion device, the refrigerant is expanded, and then passes to another heat exchanger. In the second heat exchanger, the cooler refrigerant now takes in heat from yet another fluid. The refrigerant passes from this second heat exchanger back to the compressor.

Recently, the assignee of the present invention has developed a system wherein such a refrigerant cycle is operated in a transcritical manner, and utilizing $CO_2$ as a refrigerant. This transcritical refrigerant cycle is utilized to heat a water supply in the first heat exchanger or evaporator.

Water is delivered from a source of water into a storage tank. When additional heated water is needed, the water flows from the storage tank through the gas cooler or first heat exchanger and is heated by the hot refrigerant. The water may then return to the storage tank, and can eventually be moved to a downstream use as desired.

The above-described system has beneficial attributes. However, when this system is utilized in an environment that may be subject to cold temperatures, there is a danger of damage from the water freezing such as when the system is shut down for a period of time.

SUMMARY OF THE INVENTION

In a disclosed embodiment of this invention, a refrigerant cycle is utilized to heat hot water in a condenser or gas cooler. The water flows from a source of water into a storage tank, and from the storage tank to the gas cooler. Water is heated in the gas cooler, and the heated water returns to the storage tank. Downstream of the storage tank, the water may be directed to a user as desired.

When the system is shut down, a drain valve may be opened to allow water to drain outwardly of the water supply line. In a preferred embodiment, the drain valve is positioned on the water exit from the gas cooler. Moreover, this drain valve and the water exit are preferably positioned at the vertically lowermost location in the water cycle. In this manner, water will drain outwardly from all portions of the water cycle to this drain, and there will be no water remaining in the water cycle that could freeze and damage the system components.

These and other features of the present invention can be best understood from the following specification and drawings, the following of which is a brief description.

DETAILED DESCRIPTION OF THE PREFERRED EMBODIMENT

Figure 1:
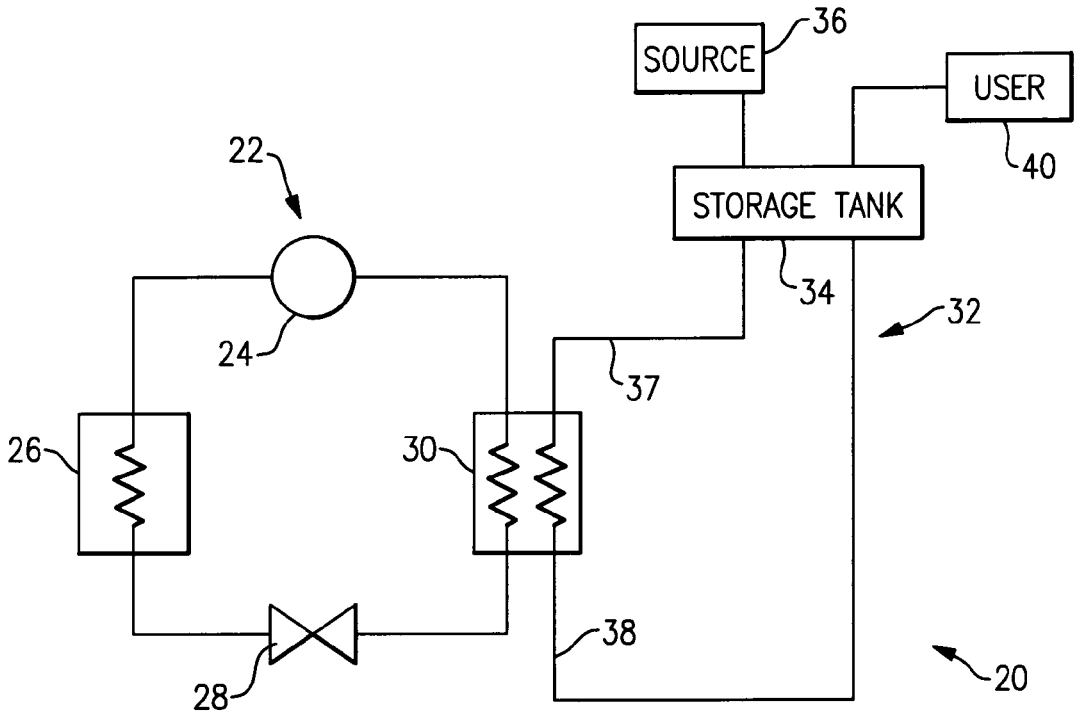
FIG. 1 is a schematic view of a refrigerant cycle for heating water.

A system for heating water 20 is illustrated in FIG. 1. A refrigerant cycle 22 includes a compressor 24 for compressing refrigerant. In one preferred embodiment, the refrigerant is $CO_2$, and the refrigerant cycle 22 operates as a transcritical refrigerant cycle. The refrigerant passes to a first heat exchanger 30, at which the hot refrigerant heats another fluid. Downstream of heat exchanger 30, the refrigerant passes to an expansion device 28, and then to another heat exchanger 26. The refrigerant cycle operates as known, and heats water in a water circuit 32. The water circuit 32 includes a storage tank 34 receiving a cool water to be heated from a source 36. The water passes through a water supply line 37 into the heat exchanger 30, and then to a downstream discharge line 38 returning to the storage tank 34. The temperature differences keep the hot and cool water separate in storage tank 34. Eventually, and as desired at a downstream user 40, the heated water is delivered out of the storage tank and to the downstream user.

Figure 2:
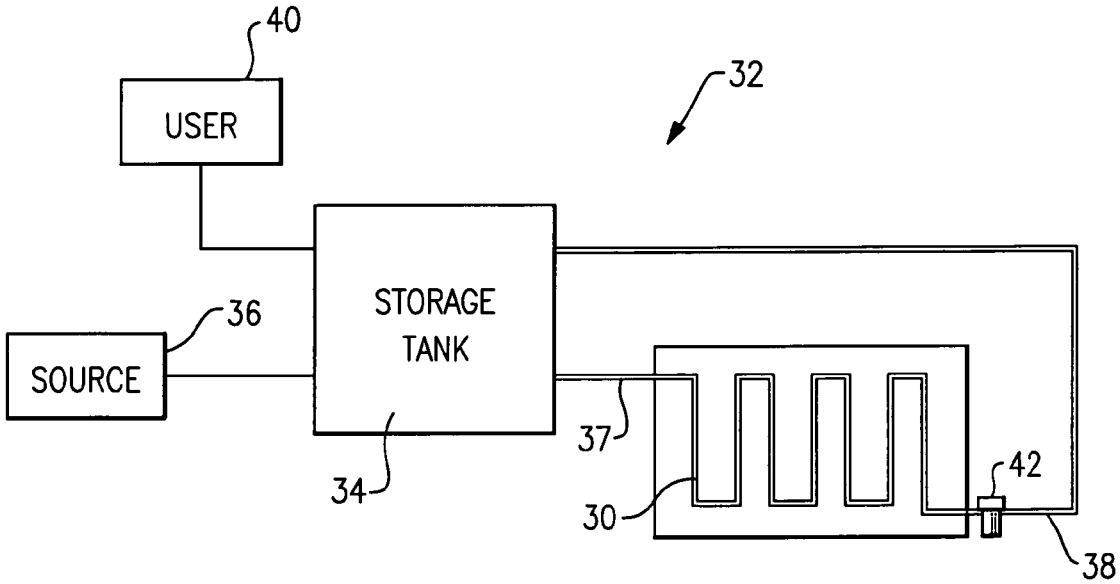
FIG. 2 is a schematic view of the water cycle portion of the FIG. 1 circuit.

FIG. 2 shows the details of a drain for the water circuit 32, such as when the system is shut down. As an example, this system may be utilized at an outside environment that may be subject to freezing temperatures at certain parts of the year. Under such circumstances, it would be desirable to drain the water out of the water circuit 32. As can be appreciated from FIG. 2, the discharge line 38 of the water supply line leaving the heat exchanger 30 is the vertically lowermost portion. A drain valve 42 is selectively placed on the line 38, and can be opened to drain water. All water will flow to this location as it is the vertically lowest portion. In this manner, the present invention ensures that all water can be drained from the water circuit 32 when the system 20 is shut down, such as for the winter. As can be appreciated from FIG. 2, the drain 42 is positioned to be immediately downstream of the heat exchanger 30, and closer to the heat exchanger 30 than it is the storage tank 34.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A system for heating water comprising:

a refrigerant cycle including a compressor for compressing refrigerant and delivering compressed refrigerant to a first heat exchanger, an expansion device downstream of said first heat exchanger, and a second heat exchanger downstream of said expansion device, refrigerant passing from said compressor to said first heat exchanger, to said expansion device, to said second heat exchanger, and then returning to said compressor;

a water circuit for passing water to be heated through said first heat exchanger, such that it can be heated by refrigerant in said first heat exchanger; and a drain for draining water at a location adjacent to said first heat exchanger from said water circuit, said drain being operable for draining water from said first heat exchanger, at least said first heat exchanger being positioned in an outdoor environment.

2. The system as set forth in claim 1, wherein water flows to said first heat exchanger from a storage tank, and is heated in said first heat exchanger and returned to said storage tank.

3. The system as set forth in claim 1, wherein said drain is a drain valve located at a vertically lowermost location on said water circuit.

4. The system as set forth in claim 1, wherein a water outlet of said first heat exchanger is said vertically lowermost location on said water circuit.

5. The system as set forth in claim 1, wherein said drain is positioned remote from a storage tank for receiving water downstream of said first heat exchanger, said drain being positioned to also drain said storage tank.

6. The system as set forth in claim 5, wherein said drain is positioned closer to said first heat exchanger than to said storage tank.

7. A system for heating water comprising:

a refrigerant cycle including a compressor for compressing refrigerant and delivering compressed refrigerant to a first heat exchanger, an expansion device downstream of said first heat exchanger, and a second heat exchanger downstream of said expansion device, refrigerant passing from said compressor to said first heat exchanger, to said expansion device, to said second heat exchanger, and then returning to said compressor;

a water circuit for passing water to be heated through said first heat exchanger, such that it can be heated by refrigerant in said first heat exchanger; and a drain for draining water at a location adjacent to said first heat exchanger from said water circuit, said drain being operable for draining water from said first heat exchanger, said drain being operable to drain the entire water circuit when opened.

8. The system as set forth in claim 7, wherein said first heat exchanger is positioned in an outdoor environment.

9. The system as set forth in claim 7, wherein water flows to said first heat exchanger from a storage tank, and is heated in said first heat exchanger and returned to said storage tank.

10. The system as set forth in claim 7, wherein said drain is a drain valve located at a vertically lowermost location on said water circuit.

11. The system as set forth in claim 7, wherein a water outlet of said first heat exchanger is said vertically lowermost location on said water circuit.

12. The system as set forth in claim 7, wherein said drain is positioned remote from a storage tank for receiving water downstream of said first heat exchanger.

13. The system as set forth in claim 7, wherein said drain is positioned closer to said first heat exchanger than to said storage tank.

* * * * *

UNITED STATES PATENT AND TRADEMARK OFFICE

CERTIFICATE OF CORRECTION

PATENT NO. : 7,310,960 B2
APPLICATION NO. : 11/068413
DATED : December 25, 2007
INVENTOR(S) : Sienel et al.

It is certified that error appears in the above-identified patent and that said Letters Patent is hereby corrected as shown below:

ON THE TITLE PAGE: (75):

Please correct Inventor Lyon's information as follows:

"Nicolas Pondicq-Cassou, Lyons (FR)" should read as --Nicolas Pondicq-Cassou, Lyon (FR)--

Signed and Sealed this

Twenty-second Day of July, 2008

JON W. DUDAS
*Director of the United States Patent and Trademark Office*